US008109545B2

(12) United States Patent
Lukas et al.

(10) Patent No.: US 8,109,545 B2
(45) Date of Patent: Feb. 7, 2012

(54) LOCK OUT MECHANISM FOR VEHICLE DOOR OUTSIDE HANDLES

(75) Inventors: Troy S. Lukas, London (CA); Oscar Renautt, Farmington Hills, MI (US); Krystof P. Jankowski, Waterford, MI (US); Carl Stanek, South Lyon, MI (US)

(73) Assignee: Intier Automotive Closures Inc, Newmarket (CA)

( * ) Notice: Subject to any disclaimer, the term of this patent is extended or adjusted under 35 U.S.C. 154(b) by 347 days.

(21) Appl. No.: 12/284,509

(22) Filed: Sep. 23, 2008

(65) Prior Publication Data

US 2009/0058107 A1 Mar. 5, 2009

Related U.S. Application Data

(62) Division of application No. 11/338,409, filed on Jan. 24, 2006, now abandoned.

(60) Provisional application No. 60/646,759, filed on Jan. 24, 2005.

(51) Int. Cl.
*E05B 3/00* (2006.01)

(52) U.S. Cl. ..... 292/336.3; 292/87; 292/DIG. 30

(58) Field of Classification Search ..... 292/336.3, 292/347, 92, DIG. 65, DIG. 30, 80, 81, 89, 292/87

See application file for complete search history.

(56) References Cited

U.S. PATENT DOCUMENTS

| | | | | |
|---|---|---|---|---|
| 3,848,909 | A | 11/1974 | Foley | |
| 4,778,207 | A | 10/1988 | Gergoe | |
| 5,560,659 | A | 10/1996 | Dault | |
| 5,901,991 | A | 5/1999 | Hugel et al. | |
| 5,975,597 | A * | 11/1999 | Makiuchi et al. | 292/336.3 |
| 6,264,257 | B1 | 7/2001 | Meinke | |
| 6,363,577 | B1 * | 4/2002 | Spitzley | 292/336.3 |
| 6,447,030 | B1 * | 9/2002 | Meinke | 292/347 |
| 6,565,134 | B1 | 5/2003 | Stuart et al. | |
| 6,575,508 | B2 | 6/2003 | Stuart et al. | |
| 7,152,893 | B2 * | 12/2006 | Pudney | 292/336.3 |
| 7,284,776 | B2 * | 10/2007 | Cummins et al. | 292/336.3 |
| 7,331,618 | B2 * | 2/2008 | Jooss et al. | 292/336.3 |
| 2006/0038417 | A1 * | 2/2006 | Pudney | 292/336.3 |
| 2006/0038418 | A1 * | 2/2006 | Huizenga et al. | 292/336.3 |

* cited by examiner

*Primary Examiner* — Carlos Lugo
*Assistant Examiner* — Mark Williams
(74) *Attorney, Agent, or Firm* — Miller Canfield

(57) ABSTRACT

A handle assembly selectively allows the door latch of a door of a motor vehicle to be released. The handle assembly includes a base fixedly secured to the door. The handle assembly also includes a handle portion and a lock trigger. The handle portion is operatively connected to a door latch mechanism effectuating the opening of the door. The lock trigger is movably engaged with the handle portion to allow or disallow the movement of the handle assembly and hence the opening of the door.

2 Claims, 5 Drawing Sheets

LOCK OUT MECHANISM FOR VEHICLE DOOR OUTSIDE HANDLES

CROSS REFERENCE TO RELATED APPLICATIONS

This application is a divisional application of U.S. application Ser. No. 11/338,409, filed Jan. 24, 2006 now abandonded and entitled "Lock Out Mechanism For Vehicle Door Outside Handles" which claims priority to and all the benefits of U.S. provisional application No. 60/646,759, filed Jan. 24, 2005.

FIELD OF THE INVENTION

This invention relates to an outside handle assembly for a motor vehicle. More particularly, the invention relates to a locking mechanism for preventing inadvertent release of a motor vehicle door when a handle portion of a handle assembly moves at an acceleration above a predetermined threshold.

DESCRIPTION OF THE PRIOR ART

Motor vehicles include at least one outside door handle for releasing a door latch mechanism in order to open a door. Typically, a user actuates the outside door handle by pivoting a handle portion relative to a base. The handle portion may, however, also be pivoted when the outside door handle is exposed to a high inertia force. The pivoting of the handle portion relative to the base in response to the high inertia force can cause inadvertent opening of the door.

In recent years, there has been development of locking mechanisms to attempt to prevent the opening of a vehicular door in the event of such a high inertia force. While the existing mechanisms work for some crash situations, there is a need in the art for a locking mechanism that does not allow the vehicle door to open in the event of a high acceleration impact or during a vehicle rollover.

SUMMARY OF THE INVENTION

According to one aspect of the invention, there is provided a handle assembly for selectively allowing the door latch of a door of a motor vehicle to be released. The handle assembly includes a base fixedly secured to the door. The handle assembly also includes a handle portion and a lock trigger. The handle portion is operatively connected to a door latch mechanism effectuating the opening of the door. The lock trigger is movably engaged with the handle portion to allow or disallow the movement of the handle assembly and hence the opening of the door.

BRIEF DESCRIPTION OF THE DRAWINGS

Advantages of the invention will be readily appreciated as the same becomes better understood by reference to the following detailed description when considered in connection with the accompanying drawings wherein.

DETAILED DESCRIPTION OF THE PREFERRED EMBODIMENT

Figure 1:
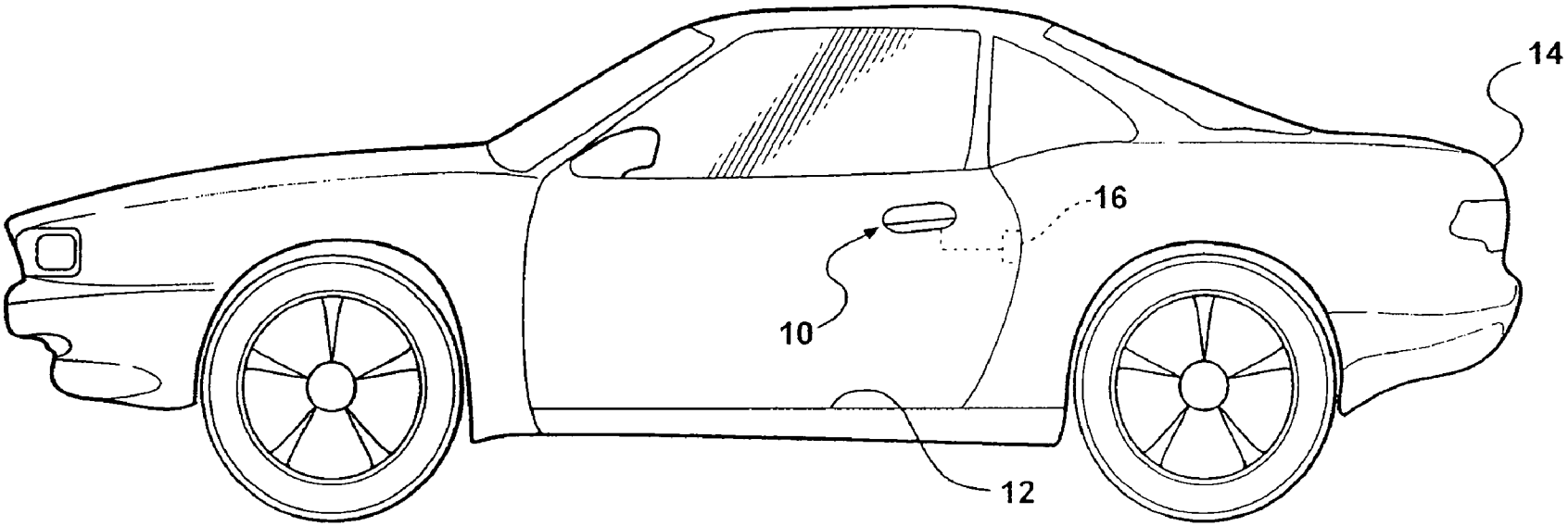
FIG. 1 is a side view of a motor vehicle including a handle assembly.

Referring to FIG. 1, a handle assembly, generally indicated at 10, is mounted to a door 12 of a motor vehicle 14. The handle assembly 10 is operatively connected to a door latch mechanism 16. When the door latch mechanism 16 is unlocked, the handle assembly 10 may be actuated from outside the motor vehicle 14 to unlatch the door latch mechanism 16 and open the door 12.

Figure 2:
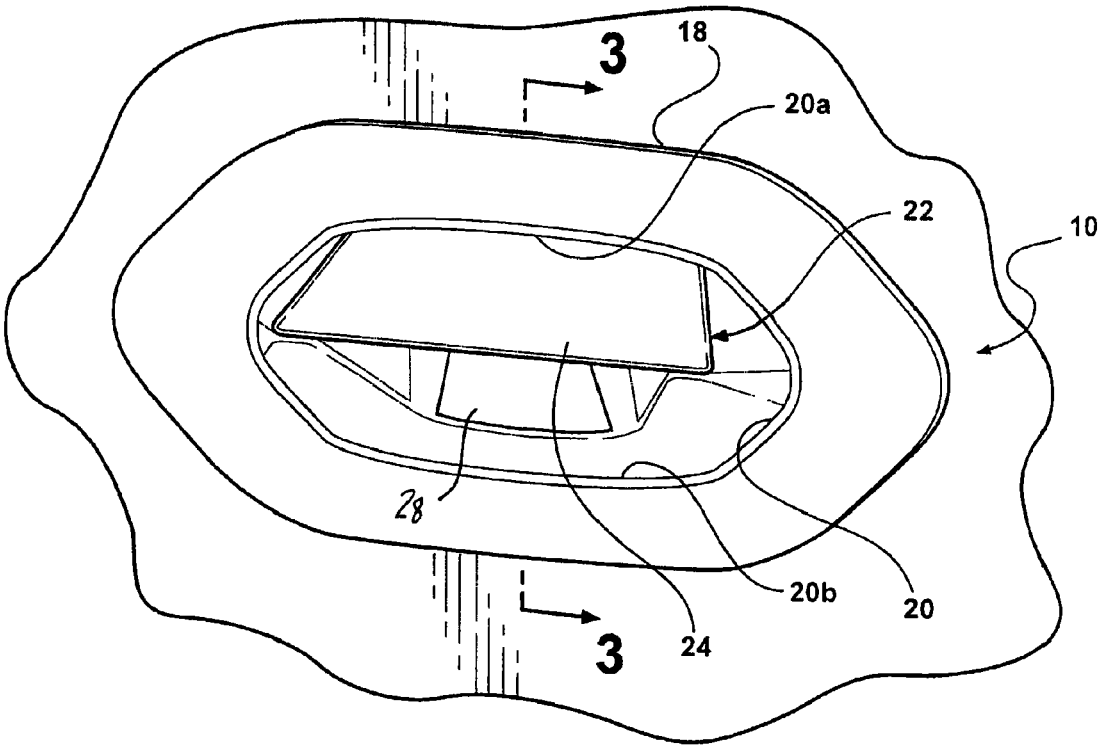
FIG. 2 is a perspective view of a first embodiment of a handle assembly in a locked position.

Referring to FIG. 2, a first embodiment of the handle assembly 10 includes a base 18 adapted to be fixedly secured to the door 12. The base 18 defines an aperture 20 having a handle edge 20*a* and a lock edge 20*b*. A handle portion 22 is pivotally coupled to the base 18 at the handle edge 20*a*. The handle portion 22 includes a grip 24 that is manually grasped by a user for pivoting the handle portion 22 at the handle edge 20*a* relative to the base 18 in order to actuate the handle assembly 10. The handle portion 22 pivots outwards from and back towards the base 20 and is operably connected to the door latch mechanism 16.

Figure 3:
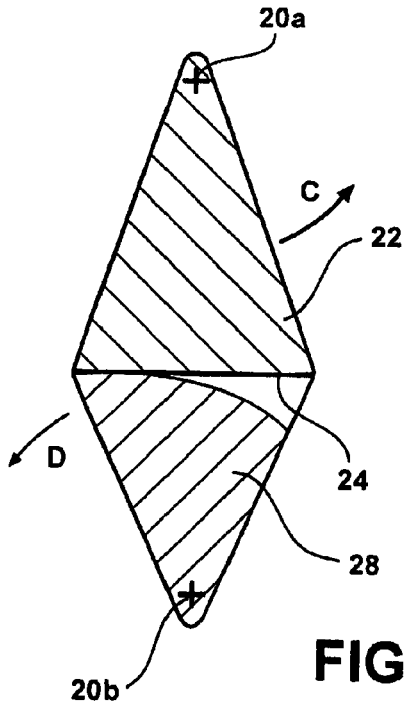
FIG. 3 is a cross-sectional view taken along lines 3-3 of the handle assembly in the locked position.

The handle assembly 10 also includes a lock trigger 28 pivotally coupled to the base 18 at the lock edge 20*b* of the aperture 20 for preventing inadvertent release of the door latch mechanism 16 when an unintended force causes the handle portion 22 to pivot relative to the base 20. The lock trigger 28 moves inwardly to unlock the handle portion 22 and back towards the outer face of the base 18 to lock the handle portion 22. The lock trigger 28 locks the handle portion 22 by abutting thereagainst preventing the pivotal movement of the handle portion 22. Referring to FIG. 3, a cross section of the handle assembly 10 is shown along lines 3-3 of FIG. 2. The handle portion 22 and the lock trigger 28 are shaped such that pivoting of the handle portion 22 outward in the direction shown by the arrow C about the handle edge 20*a* of the base 18 is prevented unless the lock trigger 28 is first pivoted inward in the direction shown by the arrow D about the lock edge 20*b* of the base 18.

Figure 4:
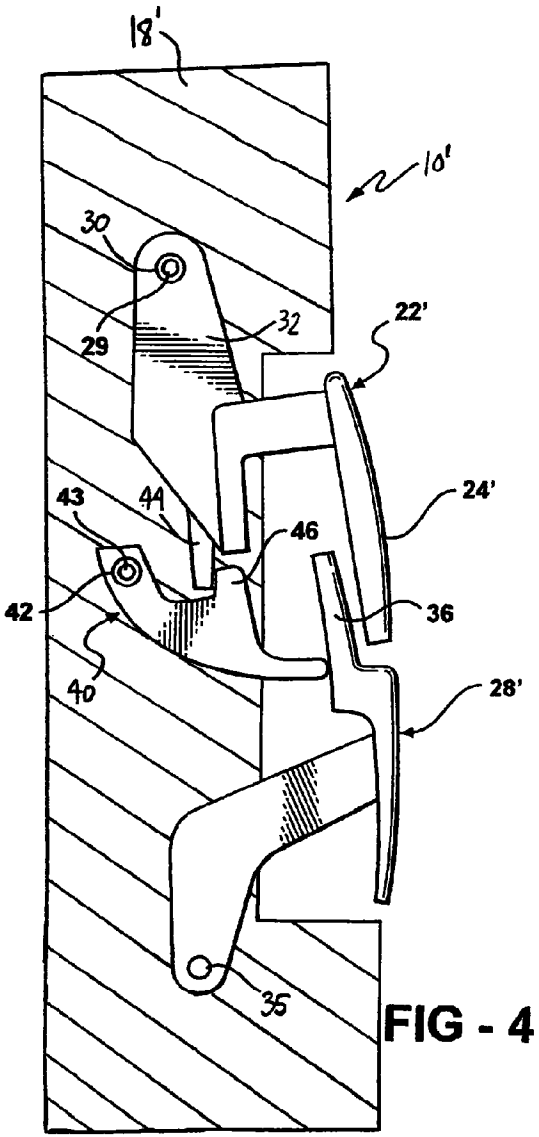
FIG. 4 is a cross-sectional side view of a second embodiment of a handle assembly in a locked position.

Referring to FIG. 4, wherein like primed reference numerals represent similar elements as those described above, a second embodiment of the handle assembly 10' is shown. The handle assembly 10' includes a base 18' adapted to be fixedly secured to the door 12'. The handle assembly 10' further includes a handle portion 22' operatively connected to the door latch mechanism 16' and a lock trigger 28' for preventing inadvertent release of the door latch mechanism 16'.

The handle portion 22' is pivotally coupled to the base 18' by a first pivot pin 29. A handle bias spring 30, operatively connected to the pivot pin 29, biases the handle portion 22' towards the base 18'. The handle portion 22' further includes an internal handle arm 32 and a grip 24' that is manually grabbed by a user for pivoting the handle portion 22' relative to the base 18' in order to actuate the handle assembly 10'. The handle portion 22' pivots about the pivot pin 29 and is operatively connected to the door latch mechanism 16'. Preferably the grip 24' is substantially L-shaped to facilitate a user pulling the handle portion 22' with a cupped hand, but it should be appreciated that the grip 24' could be a variety of shapes. The handle portion 22' also includes a lock tab 44 and will be discussed in more detail hereinbelow.

The lock trigger 28' is pivotally coupled to the base 18' by a second pivot pin 35. The lock trigger 28' includes a lock arm 36 that abuts the grip 24' to prevent the user from grabbing and pulling the grip 24' without first activating the lock trigger 28' by pivoting (pushing) the lock trigger 28' towards the base 18'. The handle assembly 10' further includes a hook lever 40 pivotally coupled to the base 18' by a third pivot pin 42, for preventing pivoting of the handle portion 22' until the lock trigger 28' has been activated. A positioning spring 43, operatively connected to the third pivot pin 42, biases the hook lever 40 to selectively abut against the lock trigger 28' and interfere with the movement thereof. The hook lever 40 includes a handle tab 46 that extends upwardly therefrom. When locked, the handle tab 46 interferes with the handle portion 22' by blocking the path of the lock tab 44, thus preventing pivoting of the handle portion 22'.

Figure 5:
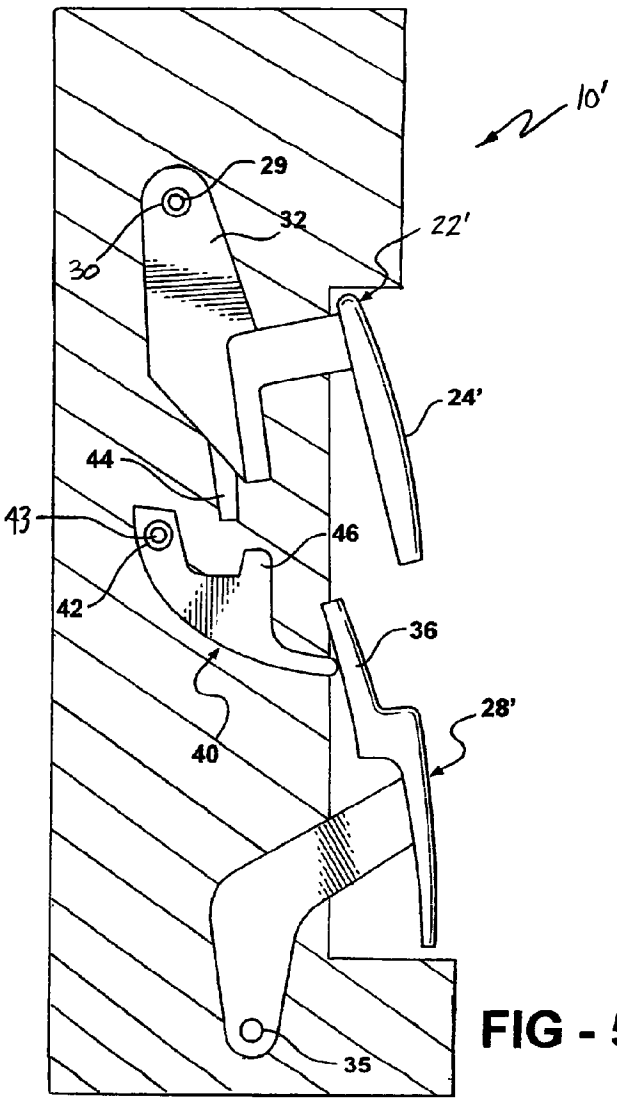
FIG. 5 is a cross-sectional side view of the second embodiment of the handle assembly in an unlocked position.

In operation, the handle assembly 22' starts in the locked position as shown in FIG. 4. In the locked position, the handle tab 46 of the hook lever 40 engages with the lock tab 44 of the handle portion 22' to prevent pivoting of the handle portion 22' and thereby preventing the opening of the door 12'. In order to open the door 12', the user must first push the lock trigger 28' inwards (counterclockwise movement when viewed from FIG. 4) causing the lock trigger 28' to pivot towards the base 19'. As the lock trigger 28' pivots about the second pivot pin 35, it operatively engages the hook lever 40, thereby causing the hook lever 40 to pivot against the positioning spring 43 (clockwise movement when viewed from FIG. 4). The pivoting of the hook lever 40 causes the handle tab 46 to move away from its blocking orientation of the lock tab 44 of the handle portion 22', as shown in FIG. 5. Once the user has pushed the lock trigger 28' inwardly (or inboard), and the handle tab 46 has moved away from the lock tab 44, the user may then pull or pivot the grip 24' of the handle portion 22' to activate the door latch mechanism 16' and open the door 12'. Once the user releases the handle portion 22' and the lock trigger 28', the handle bias spring 30 and positioning spring 43 urge the handle assembly 10' to return to the locked position.

Figure 6:
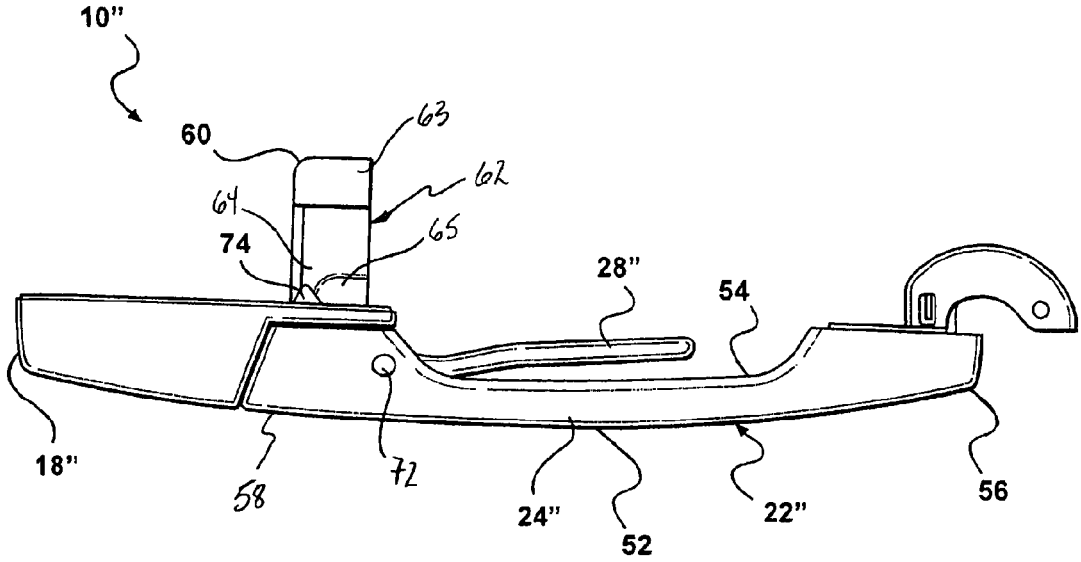
FIG. 6 is a top view of a third embodiment of a handle assembly.
Figure 7:
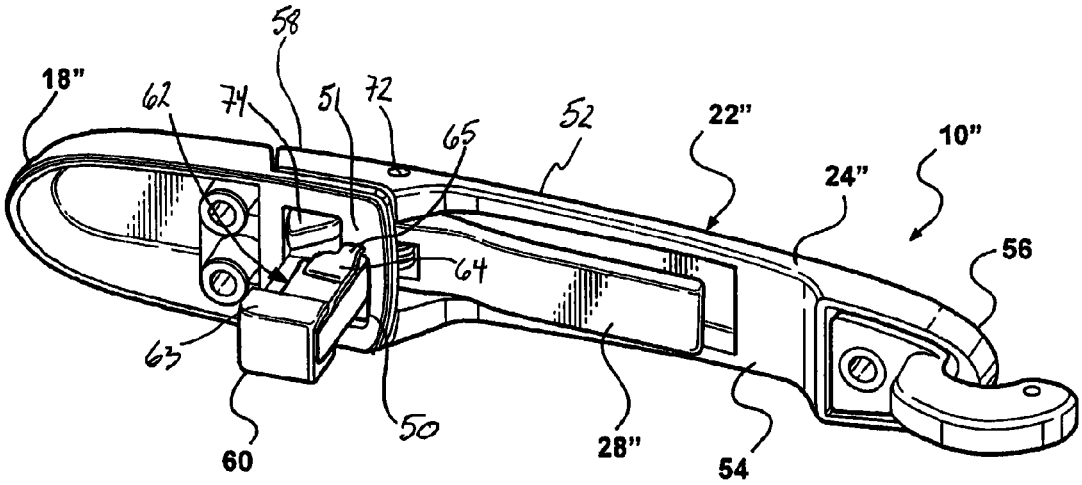
FIG. 7 is a perspective view of the handle assembly of FIG. 6.
Figure 8:
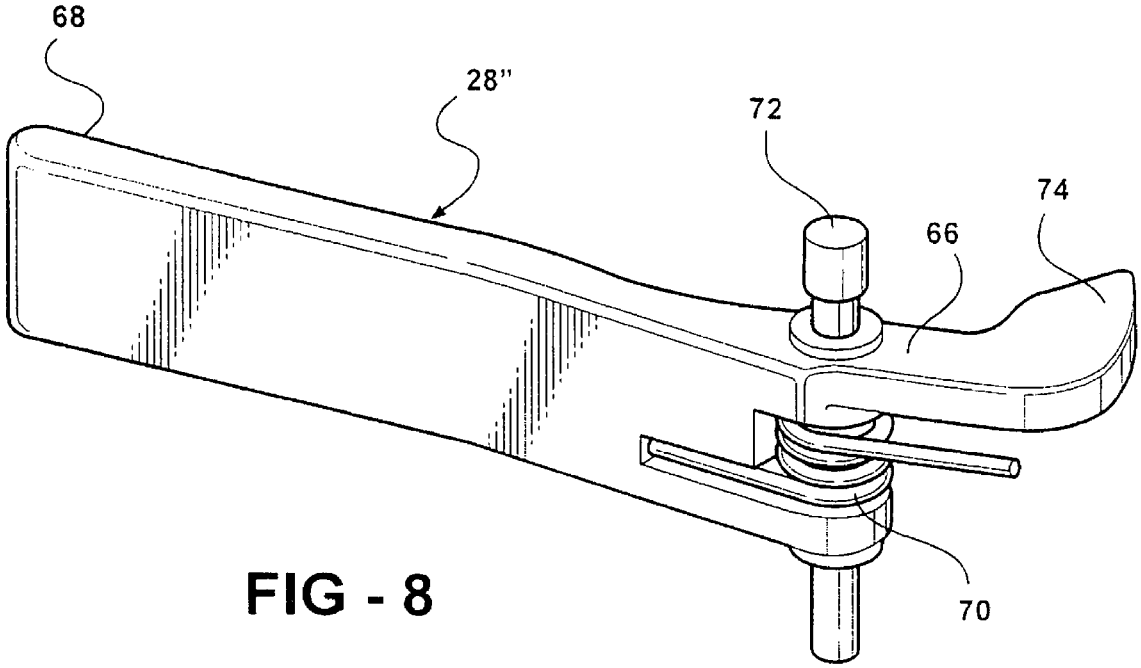
FIG. 8 is a perspective view of a lock trigger of the handle assembly of FIGS. 6 and 7.

Referring to FIGS. 6 through 8, wherein like double primed reference numerals represent similar elements as those described above, a third embodiment of the handle assembly 10" is shown. The handle assembly 10" includes a base 18" adapted to be fixedly secured to the door 12". The base 18" includes a leg aperture 50 having a relief 51. The handle assembly 10" further includes a handle portion 22" having an outboard side 52 and an opposite inboard side 54, the handle portion 22" being operatively connected to the door latch mechanism 16" and a lock trigger 28". The handle portion 22" includes a grip 24" that is manually grabbed by a user for pulling the handle portion 22" in an outboard direction relative to the base 18" in order to actuate the handle assembly 10". The handle portion 22" has a door end 56 and an opposite, base end 58. The base end 58 further includes a leg 60 extending outwardly therefrom into the door 12" and extending through the leg aperture 50 of the base 18", allowing for a sliding engagement between the leg 60 and the leg aperture 50. The door end 56 of the handle portion 22" is adapted to be pivotally engaged with the door 12".

With this configuration, the handle assembly 10" operates as a strap type outside handle as is known in the art. Typically, the user will grasp the grip 24" of the handle portion 22" and pull the handle portion 22" outboard relative to the base 18". Pulling the handle portion 22" causes the door end 56 of the handle portion 22" to pivot relative to the door 12" while the leg 60 at the base end 58 slides through the leg aperture 50 allowing the base end 58 of the handle portion 22" to extend away from the base 18".

The leg 60 of the handle portion 22" includes a stop tab 62 having a fixed end 63 and an opposite stop end 64. The fixed end 63 of the stop tab 62 is fixedly secured to the leg 60 while the stop end 64 is movable relative to the leg 60 in a springboard-like motion. The stop end 64 of the stop tab 62 includes a boss 65 which abuts the relief 51 of the leg aperture 50, thereby preventing the leg 60 from sliding through the leg aperture 50 in an outboard direction.

The lock trigger 28" is located on the inboard side 54 of the handle portion 22'. The lock trigger 28" selectively disengages the boss 65 of the stop tab 62 from the relief 51 of the leg aperture 50 to allow the sliding of the leg 60 through the aperture 50 and thereby release the door 12". Referring to FIG. 8, the lock trigger 28" has a mounting end 66 and a distal end 68. The mounting end 66 includes a spring 70, preferably a cantilever spring, fixedly attached to the mounting end 66 by a mounting pin 72. The lock trigger 28" is pivotally attached to the base end 58 of the handle portion 22" by the mounting pin 72 as shown in FIGS. 6 and 7. The mounting pin 72 defines a pivot axis, which is located such that full inertia balancing of the lock trigger 28" is possible. The spring 70 urges the lock trigger 28" away from the handle portion 22". The mounting end 66 of the lock trigger 28" further includes a tip 74 for engagement with the stop tab 62 of the leg 60. When the lock trigger 28" is pulled toward the handle portion 22", the tip 74 of the lock trigger 28" slides over the boss 65 of the stop tab 62, thereby pressing the stop tab 62 towards the leg 60. Once pressed towards the leg 60, the boss 65 of the stop tab 62 no longer abuts the relief 51 of the leg aperture 50, thereby allowing the leg 60 to slide through the aperture 50 in an outboard direction.

In operation, the lock trigger 28" prevents the normal operation of the user pulling the handle portion 22" to open the door 12" unless the lock trigger 28" is first activate. When in the locked position, the cantilever spring 70 of the lock trigger 28" urges the lock trigger 28" away from the handle portion 22". When in this position, the tip 74 of the lock trigger does not pressingly engage the boss 65 of the stop tab 62. As such, the boss 65 abuts the relief 51 of the leg aperture 50, thereby preventing movement of the handle portion 22" in the outboard direction by preventing the sliding movement of the leg 60 through the leg aperture 50. Thus, if a force is applied to pull the handle portion 22" in an outboard direction without engaging the lock trigger 28", the handle assembly 10" is locked and will not allow release of the door 12".

To unlock the handle assembly 10" and release the car door 12", the operator must first pull the lock trigger 28" toward the handle portion 22" (outward movement relative to the door 12"). As the lock trigger 28" is urged toward the handle portion 22", the tip 74 of the lock trigger 28" moves over the boss 65 of the stop tab 62, pressing the stop end 64 of the stop tab 62 towards the leg 60. Once the stop tab 62 is pressed towards the leg 60, the boss 65 no longer abuts the relief 51 of the leg aperture 50, unlocking the handle assembly 10" by allowing the leg 60 to slide through the aperture 50. Once unlocked, the operator can pull the handle portion 22" in an outboard direction to activate the door latch mechanism 16" and release the door 12".

The invention has been described in an illustrative manner, and it is to be understood that the terminology which has been used, is intended to be in the nature of words of description rather than of limitation.

Many modifications and variations of the present invention are possible in light of the above teachings. It is, therefore, to be understood that within the scope of the appended claims, the invention may be practiced other than as specifically described.

What is claimed is:

1. A door handle assembly for preventing inadvertent opening of a motor vehicle door, said door handle assembly comprising:

a base adapted to be fixedly secured to the motor vehicle door, said base including a leg aperture extending therethrough and defining a relief surface surrounding said leg aperture;

a handle extending between a door end and a base end, wherein said door end is pivotally coupled to the door and wherein said base end includes a leg extending through said leg aperture for sliding engagement therewith, said handle pivotal about said door end to open the door;

a stop tab flexibly attached to said leg of said handle for engaging said relief surface to prevent sliding movement of said leg through said leg aperture thereby preventing pivotal movement of said handle; and a lock trigger pivotally coupled to said base end of said handle, wherein said lock trigger includes a mounting end pivotally coupled to said base end of said handle and an opposite distal end spaced from said door end of said handle, said mounting end of said lock trigger including a tip portion extending through said leg aperture and selectively engaging said stop tab for disengaging said stop tab with said relief surface in response to pivotal movement of said lock trigger relative to said handle to allow sliding movement of said leg through said leg aperture and thereby allowing pivotal movement of said handle to open the door.

2. A door handle assembly as set forth in claim 1 wherein said stop tab extends between a fixed end fixedly securing said stop tab to said leg and an opposite stop end spaced from said leg and terminating at a boss for abutting engagement with said relief surface wherein said tip portion of said lock trigger presses said stop end against said leg in response to pivotal movement of said lock trigger to disengage said boss from said relief surface and allow said leg to slide through said leg aperture.

* * * * *